US005265290A

United States Patent [19]

Van Raemdonck

[11] Patent Number: 5,265,290

[45] Date of Patent: Nov. 30, 1993

[54] DEVICE FOR SUPPORTING THE SLATS OF A SLATTED BASE

[75] Inventor: René Van Raemdonck, Geraardsbergen, Belgium

[73] Assignee: Complete Investments Limited, Dublin, Ireland

[21] Appl. No.: 916,805

[22] Filed: Jul. 22, 1992

Related U.S. Application Data

[63] Continuation-in-part of Ser. No. 777,074, Oct. 16, 1991, abandoned.

[30] Foreign Application Priority Data

Oct. 16, 1990 [EP] European Pat. Off. ..... 90870191.5

[51] Int. Cl.[5] ..... A47C 23/06

[52] U.S. Cl. ..... 5/236.1; 5/241

[58] Field of Search ..... 5/236.1, 238, 241, 237, 5/191

[56] References Cited

U.S. PATENT DOCUMENTS

| | | | |
|---|---|---|---|
| 4,525,886 | 7/1985 | Savenije | 5/464 |
| 5,060,326 | 10/1991 | Oswald | 5/241 |

FOREIGN PATENT DOCUMENTS

| | | | |
|---|---|---|---|
| 0038155 | 10/1981 | European Pat. Off. | 5/238 |
| 2832584 | 2/1980 | Fed. Rep. of Germany | 5/236.1 |
| 2407692 | 6/1979 | France | 5/236.1 |

*Primary Examiner*—Alexander Grosz

*Attorney, Agent, or Firm*—Watson, Cole, Grindle & Watson

[57] ABSTRACT

A device for supporting the slats of a slatted base disposed with respect to a bed frame, each of the slats being supported by a rod which is influenced either directly or indirectly by a hydraulically or pneumatically movable component which can be displaced in a chamber, with all of the chambers being in communication with each other according to the principles of the communicating vessels, at least a portion of the above components, which are displaced under the influence of the pressure exerted onto each slat, are subjected to the action of a counterpressure spring.

9 Claims, 6 Drawing Sheets

Fig.12
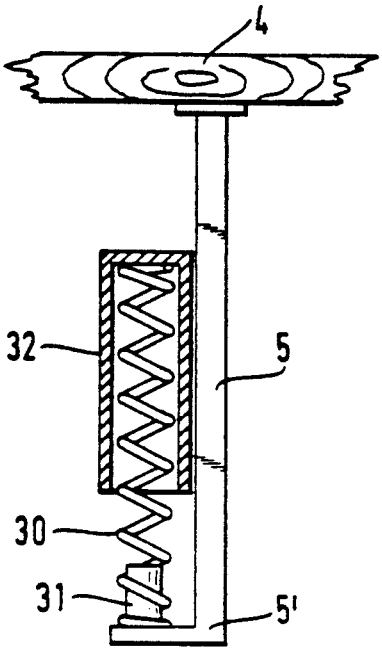
Fig.13
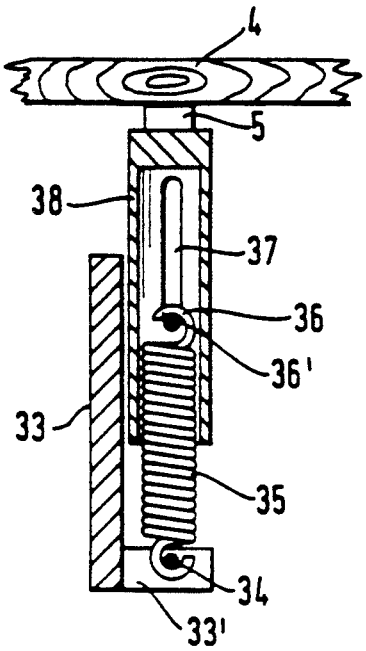
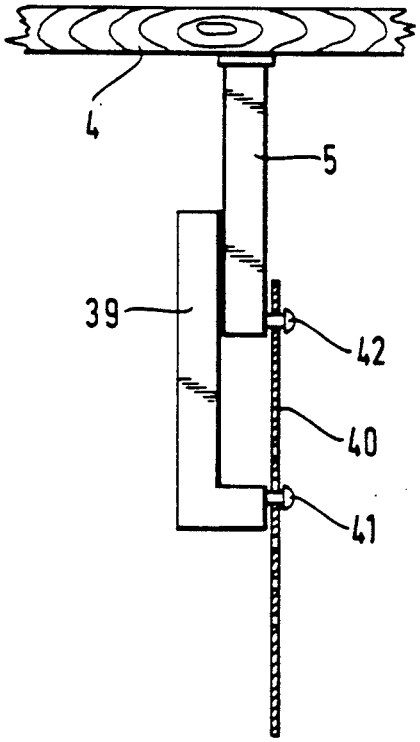
Fig.14
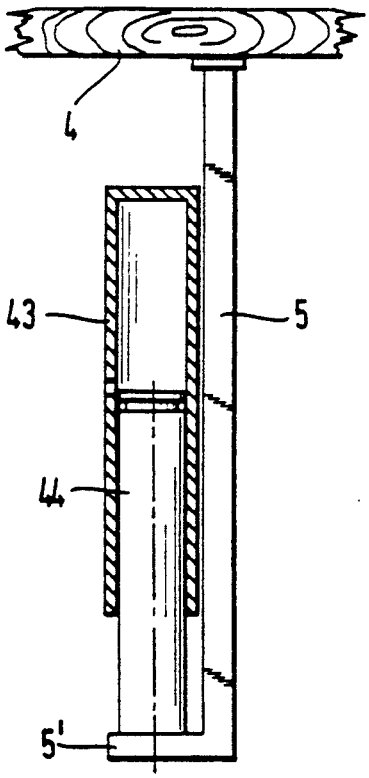
Fig.15

Fig.16
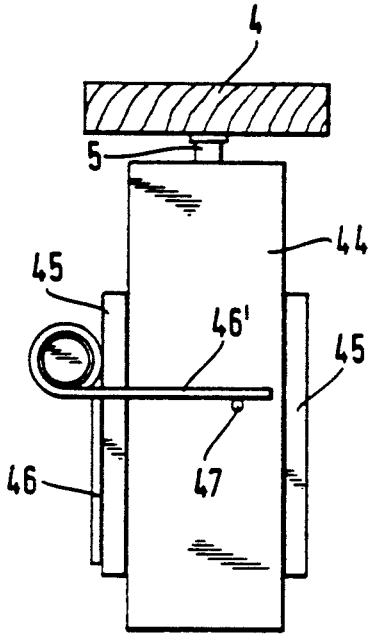
Fig.17
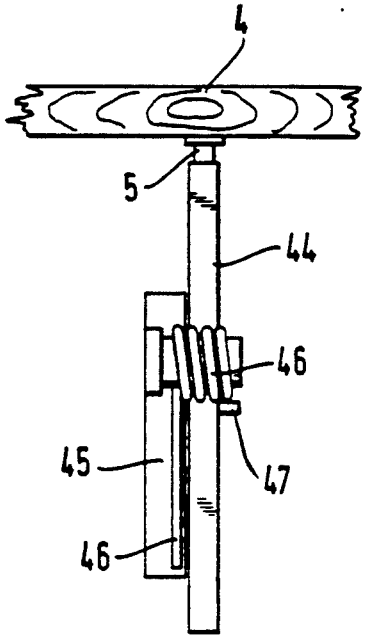
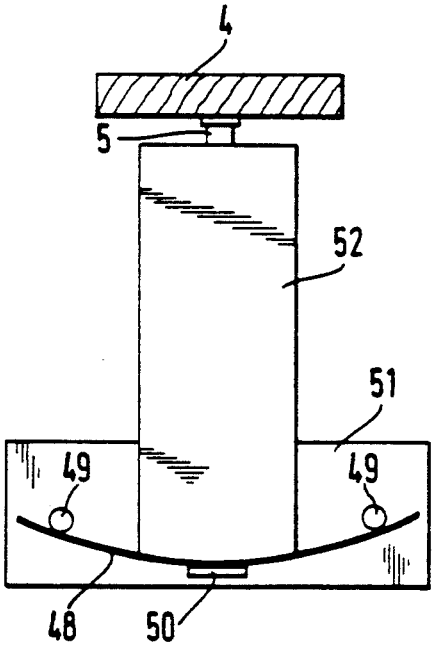
Fig.18
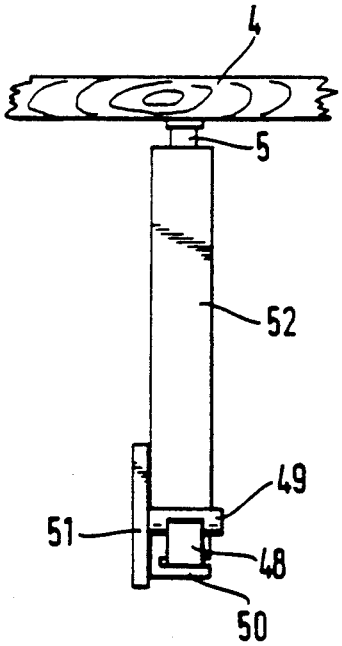
Fig.19

DEVICE FOR SUPPORTING THE SLATS OF A SLATTED BASE

CROSS REFERENCE TO RELATED APPLICATION

This application is a continuation-in-part of application Ser. No. 777,074, filed Oct. 16, 1991 now abandoned.

BACKGROUND AND SUMMARY OF THE INVENTION

This invention relates to a device for supporting the slats of a slatted base disposed with respect to a bed frame, each of the slats being supported by a rod which is influenced either directly or indirectly by a hydraulically or pneumatically movable component which can be displaced in a chamber, with all of the chambers being in communication with each other according to the principles of the communicating vessels.

An example of a similar embodiment can be found in Belgian Patent No 806 241, as well as in published PCT-application WO 89/01749 and in U.K. Patent No. 2 178 307. According to these documents, different cylinders or technically equivalent chambers are connected to each other at both sides of the slatted base by means of a duct so that the different cylinders or chambers act as communicating vessels.

In an embodiment of the above kind, the central portion of the slatted base will come down completely up to a lowermost point when the user is going to lie down and this independent of the position of the user. This is due to the fact that the heaviest portion of the body is located on this central portion.

An object of the invention is now to provide a solution for these and other drawbacks of such supports for slatted bases and to prescribe a device which considerably improves the resilient support of such slatted bases.

In order to realize this according to the invention, at least a portion of the above components, which are displaced under the influence of the pressure exerted upon each slat, are subjected to the action of a counterpressure spring.

In a first possible embodiment, the hydraulically or pneumatically movable component comprises a piston, the piston rod of which corresponds to the rod.

In another possible embodiment, the hydraulically movable component is a membrane to which the rod is connected.

According to a remarkable, preferably used embodiment, the movable component is a roll membrane which acts upon a rod guided in the chamber.

Other details and advantages of the invention will become apparent from the following description of a device for supporting the slats of a slatted base according to the invention. This description in only given by way of example and does not limit the invention. The reference numerals relate to the figures annexed hereto.

BRIEF DESCRIPTION OF THE DRAWINGS

FIGS. 12 and 13 show two possible arrangements of a counterpressure spring between a fixed and a movable component.

FIG. 14 shows a possible arrangement of a rubber spring.

FIG. 15 shows a possible arrangement of an air-spring.

FIG. 16 shows a front elevation view of the arrangement of a torsion spring.

FIG. 17 shows a side elevation view of the arrangement of the torsion spring from FIG. 16.

FIG. 18 shows a front elevation view of the arrangement of a leaf spring.

FIG. 19 shows a side elevation view of the arrangement of the leaf spring from FIG. 18.

DETAILED DESCRIPTION OF THE PREFERRED EMBODIMENTS

Figure 1:
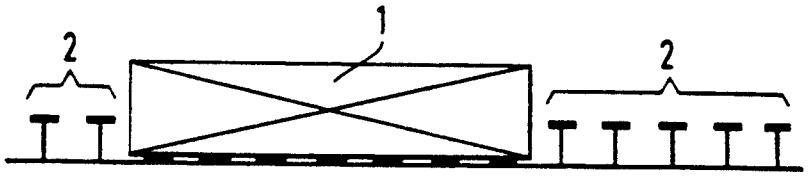
FIG. 1 is a theoretical representation of the problem which is posed when a certain weight rests upon a slatted base.
Figure 2:
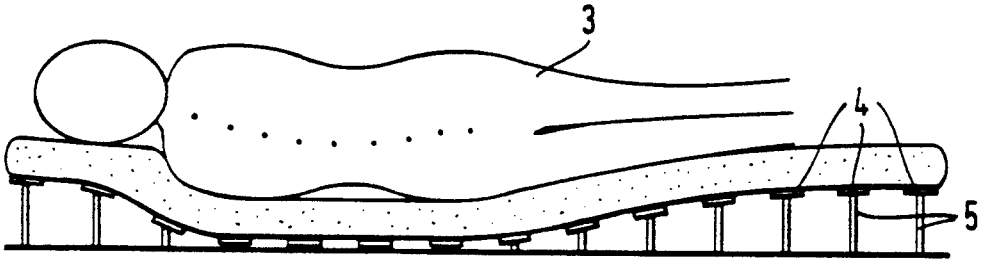
FIG. 2 illustrates the pressure distribution on the slatted base without counterpressure spring.

When reference is first made to FIGS. 1 and 2, it will be seen that the upward and downward movement of the slatted base is caused by laying a weight 1 onto these slats. In this way, an internal liquid circulation is created in the cylinders or chambers, which will be described hereinafter in more detail. The liquid must flow since it is not compressible. If this does not happen, no movement will be possible. The term "chamber" will be used in the description and claims since this term includes as well a hydraulic as a pneumatic support.

The above displacement of the slats which compose the slatted base is slowed down, in a usual way, by diaphragming the outlets of the chambers or cylinders. As a result of the linear movement of a number of slats belonging to the slatted base, as represented in FIG. 1, a downward pressure is created so that the slats onto which a pressure is exerted are located completely in a lowermost position. The other slats, which do not carry a weight, are shifted to their uppermost position. This situation arises of course in the supposition that in the neutral rest position all chambers are half-filled.

An analogous situation, derived from this theoretical situation, is represented in FIG. 2. In FIG. 2, the heaviest portion of the body 3 rests in the middle of the slatted base measured in the longitudinal direction. In this schematic figure, the slatted base is represented by reference 2. FIG. 2 is a representation of a slatted base wherein all slats 4 are supported by rods 5 and are either pushed in completely under the heaviest portions of the body or are completely in their highest position on the places where no or an insignificant pressure is exerted onto the same slats.

Figure 3:
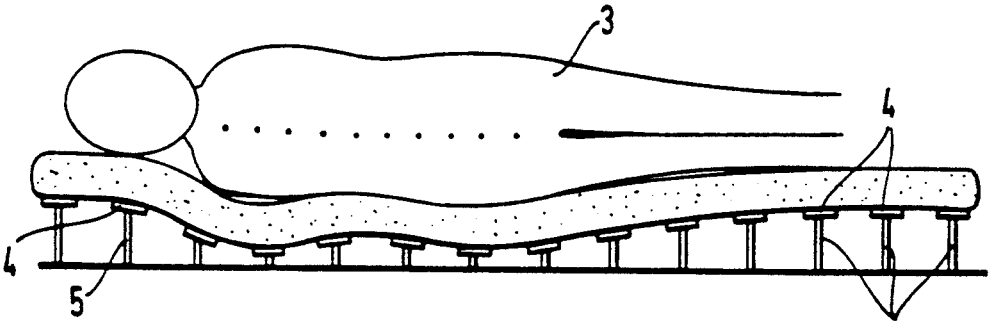
FIG. 3 illustrates the same pressure distribution when use is made of a counterpressure spring.

FIG. 3 schematically illustrates an example of the case wherein the body 3 of the user rests onto slats 4 which are themselves supported by rods 5 which are subjected in one of the hereinafter described ways to the action of a counterpressure spring. In this example, an ideal distribution of the slats is clearly obtained and a clear intermediate position of the slats can be noticed between a position wherein they were normally completely pushed in and a second wherein they would be located in their highest position. The way wherein a counterpressure spring can be inserted in a slatted base according to the invention is described hereinafter by means of a considerable number of examples.

Figure 4:
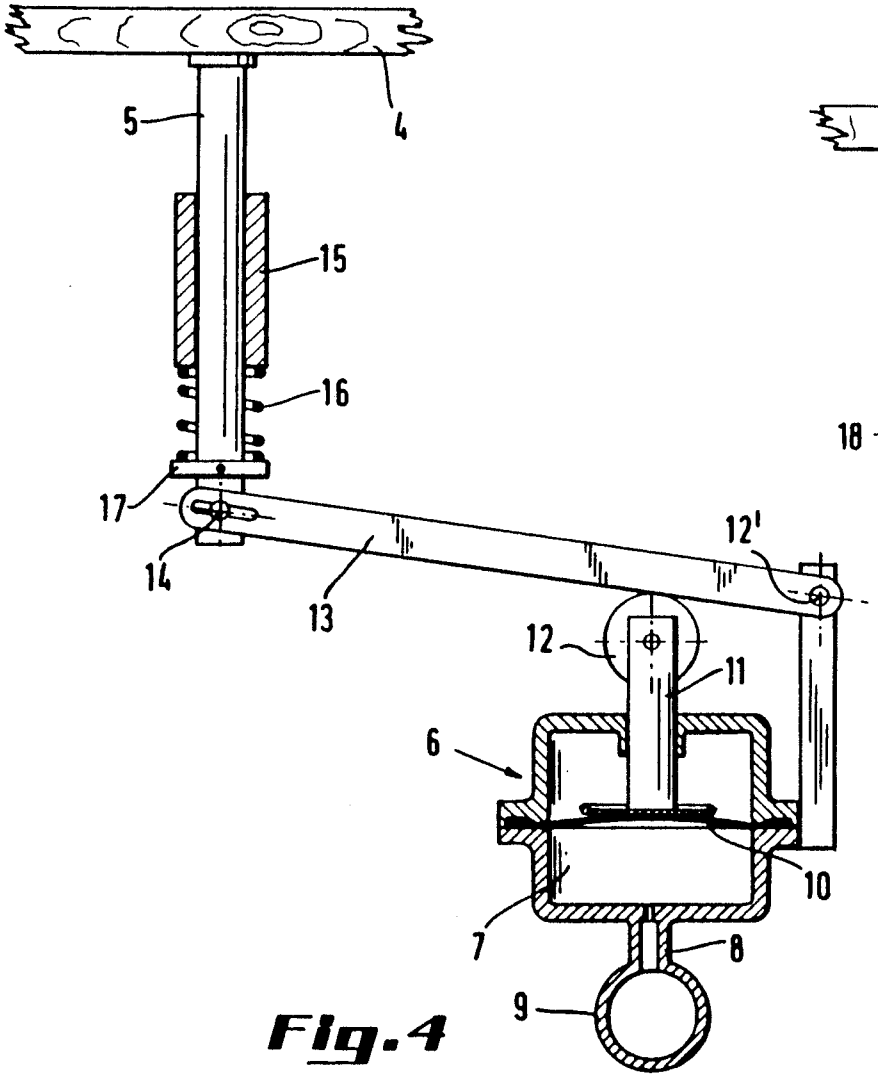
FIG. 4 shows a first embodiment wherein use is made of a membrane and of a counterpressure spring (first variant).

According to FIG. 4, a space 7 is provided at the bottom of chamber 6, which space is in communication through a narrowing 8 with the duct 9 which connects all the chambers 6 from a series. A membrance 10 delimits the space 7 at the top. Onto the membrane 10 is fixed a rod 11 having a rotatable support point in 12 for a lever 13 which is hingedly connected in a slot 14 to rod 5. This rod goes through component 15 which is fixed with respect to the bed of supporting slats 4. Between this component 15 and a pin 17 projecting at the bottom out of the rod 5 is disposed a push spring 16. This push spring 16 provides the counterpressure according to the invention. For the sake of completeness, the hinge point of lever 13 is indicated in FIG. 4 to 7 by 12'.

Figure 5:
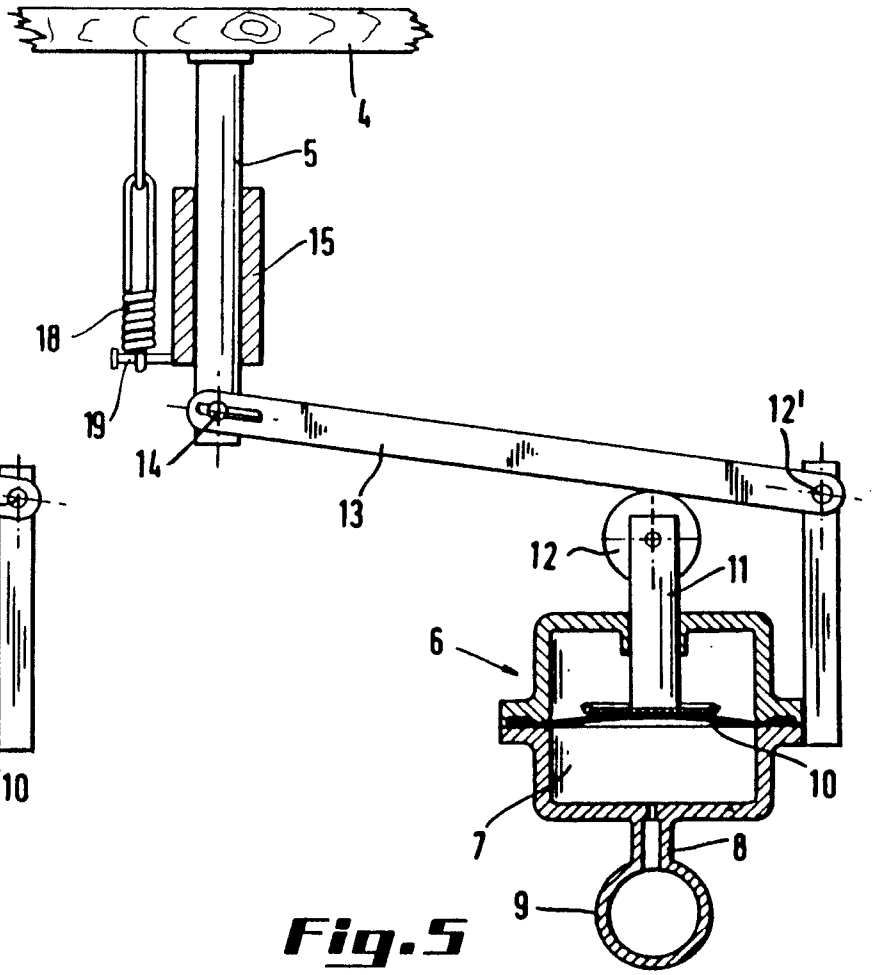
FIG. 5 shows the embodiment of FIG. 4 with a counterpressure spring according to a second variant.

In FIG. 5. the counterpressure spring 18 is a tension spring which can be stretched between a slat 4 and a pin 19 projecting at the bottom out of component 15.

Figure 6:
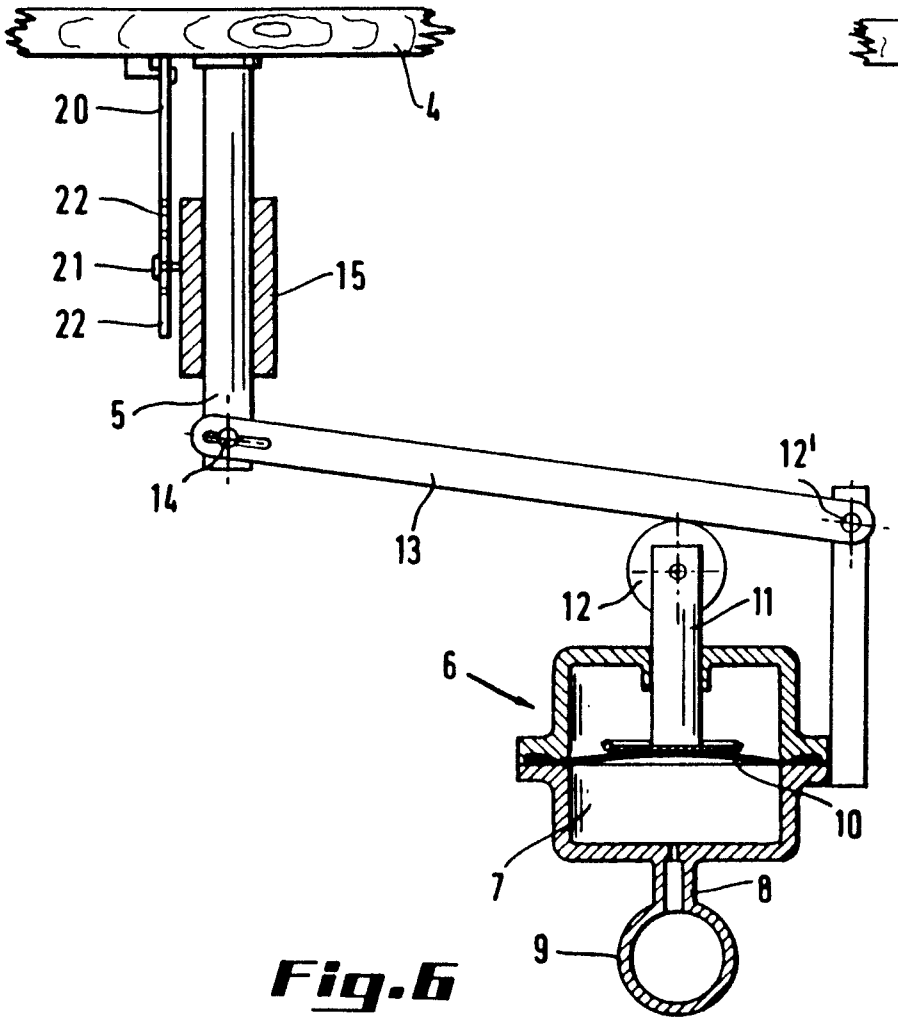
FIG. 6 shows the embodiment of FIG. 4 with a counterpressure spring according to a third variant.

In the embodiment according to FIG. 6 use is also made of a counterpressure spring provided as a tension spring 20 which is also, stretched between a slat 4 and component 15. At the bottom, the tension spring 20, which has openings 22 provided therefore, is fixed onto a pin 21 which is itself a part of component 15.

Figure 7:
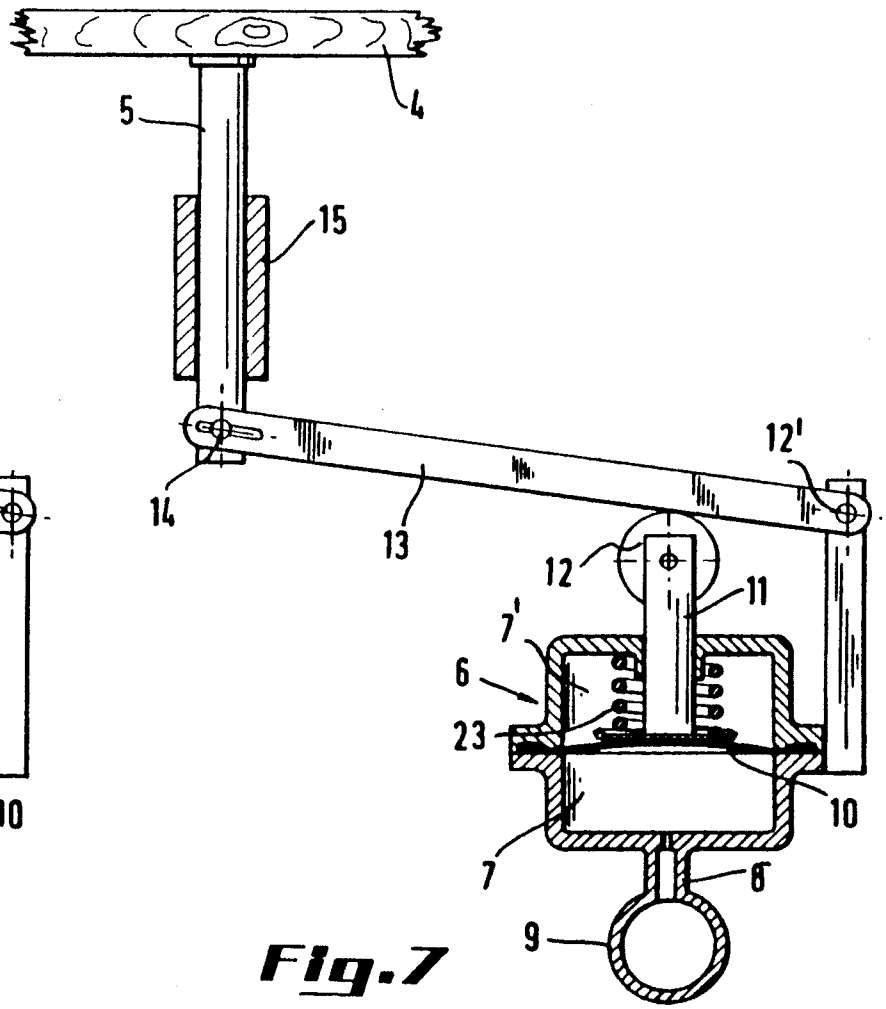
FIG. 7 shows the embodiment according to FIG. 4 with a counterpressure spring according to a fourth variant.

According to FIG. 7, a push spring located in the space 7' of chamber 6 is used as the counterpressure spring 23.

In FIGS. 8 to 11 included, a roll membrane 24 is applied in each of the chambers 6. Roll membranes have a very flexible structure so that it is as if a portion of the roll membrane rolls up and unrolls between the inner wall of chamber 6 and the outer wall of a piston 25 which is fixed at the bottom onto a rod 5. Piston 25 is guided with respect to chamber 6 in a small cylindrical portion 26 which is at the top and internally a part of the chamber 6.

Here also, the narrowings 8 and the ducts 9 which mutually connect all the chambers from a same series can be seen.

Figure 8:
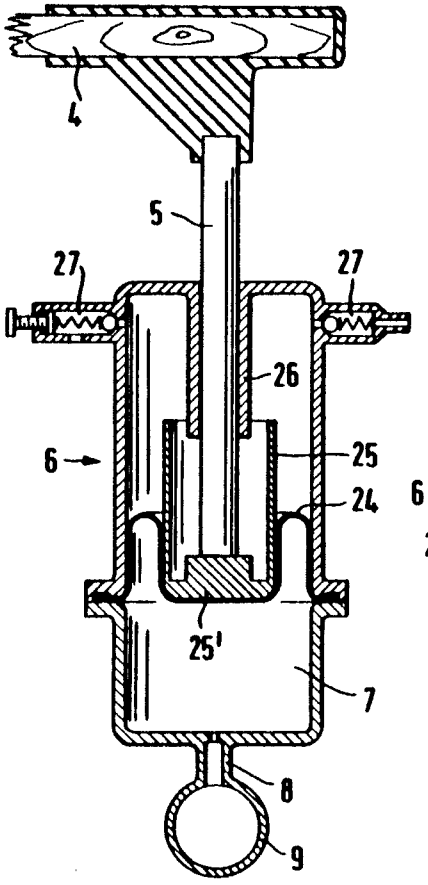
FIG. 8 shows an embodiment with a roll membrane wherein use is made as the counterpressure spring of an adjustable air-pressure.

As the counterpressure spring use is made in the embodiment according to FIG. 8 of a controllable oil- or air-pressure in chamber 6 above roll membrane 24. In order to control this pressure, use is made of adjustable valves, for example ball valves 27.

Figure 11:
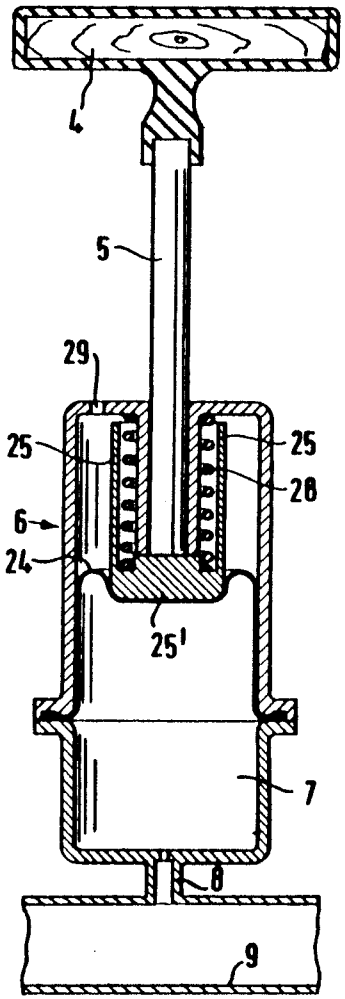
FIGS. 9, 10 and 11 show an embodiment with roll membrane and counterpressure spring in three successive positions.
Figure 10:
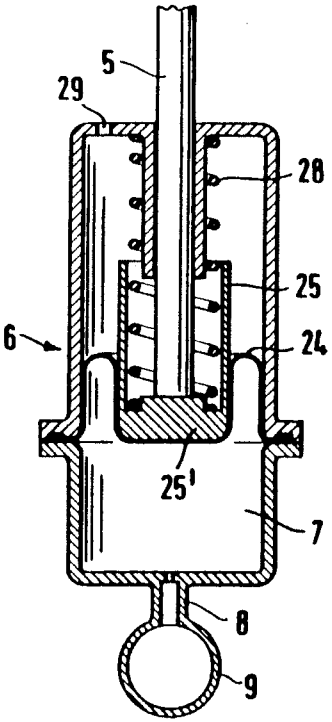
Figure 9:
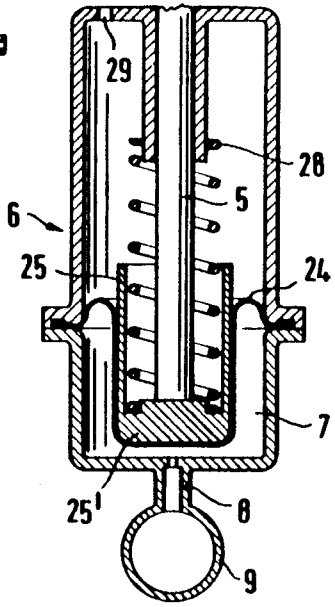

In the embodiment according to FIGS. 9, 10 and 11, which show one and the same structure in three different work positions, use is made as the counterpressure spring of a spiral spring 28 which is applied around rod 5 and which can be compressed between the uppermost inner portion of a chamber 6 and the inner bottom 25' of piston 25. Passage openings 29 are provided at the top in each of the chambers 6 of the embodiment according to FIGS. 9, 10 and 11.

In FIG. 9 the space 7 which is delimited by roll membrane 24 in chamber 6, is reduced to its minimum volume.

FIG. 10 shows an intermediate position wherein the volume of space 7 is increased and wherein spiral spring 28 can or shall start to become compressed between bottom 25' of piston 25 and the uppermost edge of chamber 6.

FIG. 11 shows how space 7 has taken in a maximum volume and how the counterpressure spring 28 is completely compressed.

The embodiments according to FIGS. 12 and 13 show particular possible arrangements of a push spring (FIG. 12) and a tension spring (FIG. 13). According to FIG. 12, the counterpressure spring 30 is caught between a pin 31 which moves together with rod 5 since pin 31 is fixed onto a side arm 5' of the rod 5. The uppermost portion of counterpressure spring 30 fits into a cylindrical housing 32 which has to be considered as a fixed component with respect to the frame of the bed or of the sitting furniture.

The embodiment according to FIG. 13 comprises a component 33 which is fixed with respect to the bed frame. This component shows at the bottom, sideways, an arm 33' with a small pin 34 around which one extremity of the tension spring 35 catches. At the top, spring 35 ends also in a hook 36 onto which is welded a small pin 36' which is slidable along the slot 37 of the cylindrical housing 38. The cylindrical housing 38 forms a whole with rod 5 which is itself connected to the slat 4. When the slat 4 is pushed down further together with the rod 5, the cylindrical housing 38 will move downwards over a distance which corresponds substantially to the slot 37.

The embodiment according to FIG. 14 shows in a very concise way a resilient counterpressure spring, preferably composed of rubber or of another elastomer, referred to with reference 40, can be stretched between fixed component 39 (fixed with respect to the bed frame) and a rod 5, between the small pins 41 and 42 respectively belonging to the fixed component 39 and the rod 5.

In the embodiment according to FIG. 15, the counterpressure spring is formed by a cylinder 43. A piston 44 is connected to rod 5, the base of which piston is rigidly connected to the side arm 5' of rod 5. In this embodiment use is made of an air-spring to accomplish the function of the counterpressure spring.

FIGS. 16 and 17 show the same embodiment. The rod 5 forms here one unit with a plate 44 which is slidable in a guide 45 which has to be considered as a fixed component with respect to the bed frame. A torsion spring 46 is fixed to the guide 45, which torsion spring pushes with its arm 46' against a small pin 47 fixed into plate 44.

Finally, the counterpressure spring can be a leaf spring as shown in FIGS. 18 and 19. The leaf spring 48 is mounted onto a carrier piece 51, which is fixed with respect to the bed frame, so as to be positioned between, on the one hand, the small pins 49 and, on the other hand, a stop block 50, so as to push against the plate 52 which is rigidly connected to rod 5.

It has to be emphasized clearly that in the hereinabove given description no distinction is made between the different supports for the slats of a slatted base. The presence of a counterpressure spring for all components which are each subjected to the influence of a pressure exerted onto a slat, is however not absolutely necessary.

For certain for example medical reasons, the counterpressure springs can be modified or omitted locally.

The invention is not limited to the hereabove described embodiment and it could be modified in many ways without leaving the scope of the patent application.

What is claimed is:

1. In a device for supporting the slats of a slatted base disposed on a bed frame, comprising two series of fluidically operative chambers communicating with one another hydraulically or pneumatically, each of said chambers being provided with a hydraulically or pneumatically movable component partitioning said chamber and said component being connected to a rod for supporting either directly or indirectly one end of said slats, said rod being provided for executing an upward and downward movement between an uppermost and a lowermost position as well under the influence of the hydraulic or pneumatic pressure exerted onto said component as under the influence of gravity forces exerted onto the respective slat by a user's weight, the improvement wherein each chamber is provided with counterpressure means for resiliently limiting the upward movement of the respective rod by exerting a downward force onto said rod as it approaches its uppermost position without hampering the downward movement of the rod to its lowermost position.

2. A device as claimed in claim 1, wherein said counterpressure means comprise a counterpressure spring provided for urging the respective rod downwards when it approaches its uppermost position.

3. A device as claimed in claim 1, wherein said hydraulically or pneumatically movable component is a membrane, said rod cooperates with.

4. A device as claimed in claim 3, wherein said membrane acts directly upon said rod.

5. A device as claimed in claim 3, wherein said membrane acts indirectly upon said rod by means of a lever.

6. A device as claimed in claim 1, wherein said hydraulically or pneumatically movable component is a roll membrane which acts upon a rod guided in said chamber.

7. A device as claimed in claim 1, wherein said counterpressure means is a spiral spring coiled around said rod.

8. A device as claimed in claim 1, wherein said counterpressure means is a resilient element fixed outside said chamber, between the extremity of a slat and said bed frame.

9. A device as claimed in claim 1, wherein said counterpressure means is mounted outside said chamber, between said rod and said bed frame, on a component rigidly connected to the latter.

* * * * *